US010724509B2

(12) United States Patent
Domke

(10) Patent No.: US 10,724,509 B2
(45) Date of Patent: Jul. 28, 2020

(54) ELECTRIC CONTROL VALVE FOR A COOLANT COMPRESSOR

(71) Applicant: TE Connectivity Germany GmbH, Bensheim (DE)

(72) Inventor: Daniel Domke, Frankenthal (DE)

(73) Assignee: TE CONNECTIVITY GERMANY GMBH, Bensheim (DE)

( * ) Notice: Subject to any disclaimer, the term of this patent is extended or adjusted under 35 U.S.C. 154(b) by 253 days.

(21) Appl. No.: 15/825,820

(22) Filed: Nov. 29, 2017

(65) Prior Publication Data

US 2018/0080440 A1 Mar. 22, 2018

Related U.S. Application Data

(63) Continuation of application No. PCT/EP2016/062089, filed on May 27, 2016.

(30) Foreign Application Priority Data

May 29, 2015 (DE) ..... 10 2015 007 032
Jul. 15, 2015 (DE) ..... 10 2015 213 230

(51) Int. Cl.
*F04B 27/18* (2006.01)
*F25B 49/02* (2006.01)

(52) U.S. Cl.
CPC ..... *F04B 27/1804* (2013.01); *F25B 49/022* (2013.01); *F04B 2027/1813* (2013.01);
(Continued)

(58) Field of Classification Search
CPC ..... F04B 27/1804; F04B 2027/1827; F04B 2027/1854; F04B 2027/1813;
(Continued)

(56) References Cited

U.S. PATENT DOCUMENTS 6,733,246 B2 5/2004 Imai et al.
7,000,892 B2 * 2/2006 Kim ..... F16K 11/07 137/625.65
(Continued)

FOREIGN PATENT DOCUMENTS

CN 1441165 A 9/2003
CN 101107446 A 1/2008
(Continued)

OTHER PUBLICATIONS

Abstract of DE 10 2007 028 340, dated Jan. 31, 2008, 2 pages.
(Continued)

*Primary Examiner* — Peter J Bertheaud

(57) ABSTRACT

An electric control valve for a coolant compressor comprises a valve housing, an electric actuating drive, a valve body displaceable by the electric actuating drive between a first position and a second position inside the valve housing, a position sensor determining a position of the valve body, a suction-pressure sensor, and a control system. The control system is adapted to control a coolant flow from a high-pressure region into a crankcase-chamber-pressure region of the coolant compressor by controlling the position of the valve body via the electric actuating drive based on the suction pressure received from the suction-pressure sensor. The control system moves the valve body to the first position to connect the high-pressure region and the crankcase-chamber-pressure region if the suction pressure is below a predetermined threshold.

17 Claims, 1 Drawing Sheet

(52) U.S. Cl.
CPC ..... *F04B 2027/1818* (2013.01); *F04B 2027/1827* (2013.01); *F04B 2027/1831* (2013.01); *F04B 2027/1854* (2013.01); *F04B 2027/1859* (2013.01); *F25B 2700/1933* (2013.01)

(58) Field of Classification Search
CPC ..... F04B 2027/1859; F04B 2027/185; F04B 2027/1831; F04B 2027/1895; F04B 2027/1818; B60H 2001/3275; F25B 49/022; F25B 2700/1933
USPC ..... 417/222.2
See application file for complete search history.

(56) References Cited

U.S. PATENT DOCUMENTS

| | | | | |
|---|---|---|---|---|
| 7,210,911 | B2 * | 5/2007 | Ota | F04B 27/1804 417/222.2 |
| 2009/0123300 | A1 | 5/2009 | Uibel | |
| 2011/0182753 | A1 | 6/2011 | Taguchi | |
| 2015/0004010 | A1 | 1/2015 | Saeki et al. | |

FOREIGN PATENT DOCUMENTS

| | | | |
|---|---|---|---|
| DE | 10 2007 028 340 | A1 | 1/2008 |
| DE | 10 2011 117 354 | A1 | 5/2013 |
| EP | 1375918 | A1 | 1/2004 |
| EP | 2821649 | A2 | 1/2015 |
| JP | 2992118 | B2 | 12/1999 |
| JP | 2008-527244 | A | 7/2008 |
| JP | 2010065649 | A | 3/2010 |
| KR | 10-0430052 | | 5/2004 |

OTHER PUBLICATIONS

PCT Notification, The International Search Report and the Written Opinion of the International Searching Authority, dated Jul. 28, 2016, 11 pages.
Korean Notice to File a Response with English translation, Korean Patent Application No. 10-2017-7037738, dated Nov. 27, 2018, 17 pages.
Abstract of JP 2992118 B2, dated Dec. 20, 1999, 1 page.
Chinese First Office Action with English translation, dated Aug. 28, 2018, 11 pages.

* cited by examiner

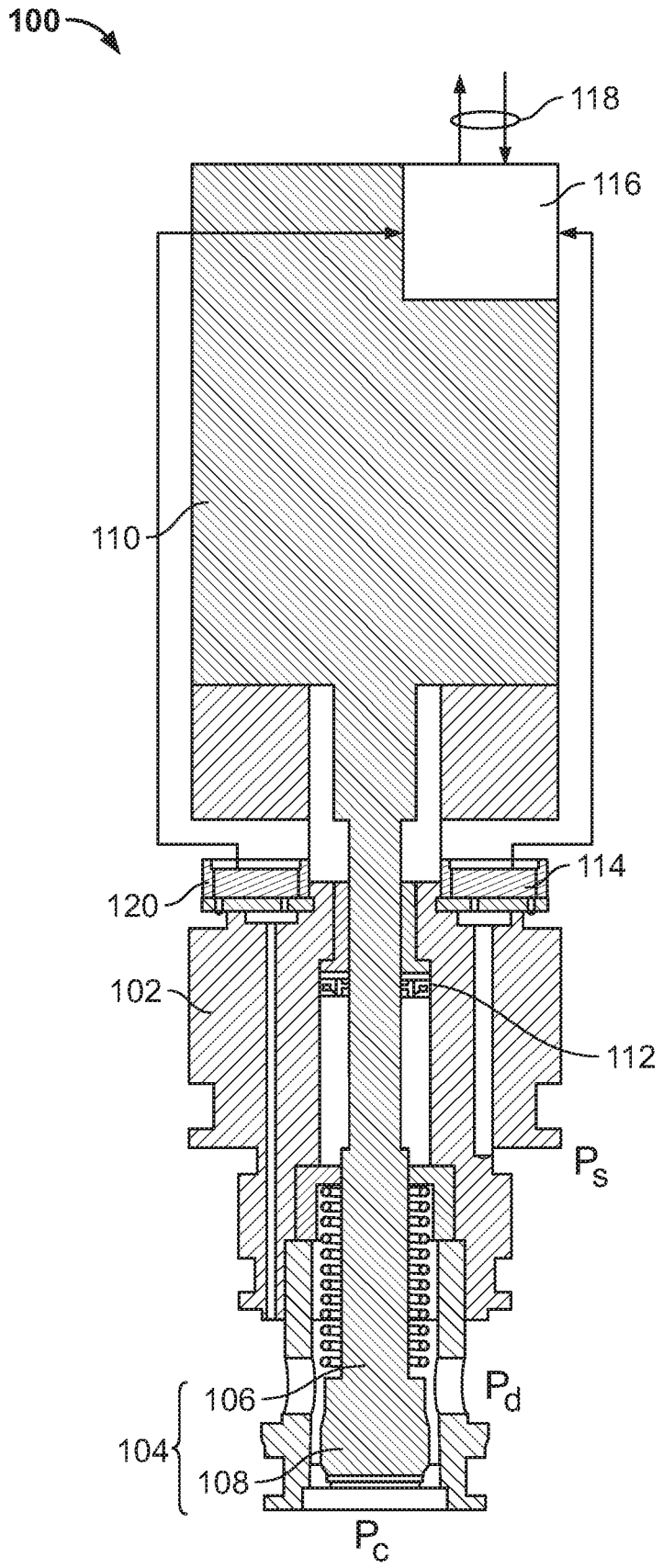
100
118
116
110
114
120
102
112
$P_s$
$P_d$
106
104
108
$P_c$

ELECTRIC CONTROL VALVE FOR A COOLANT COMPRESSOR

CROSS-REFERENCE TO RELATED APPLICATIONS

This application is a continuation of PCT International Application No. PCT/EP2016/062089, filed on May 27, 2016, which claims priority under 35 U.S.C. § 119 to German Patent Application No. 102015213230.7, filed on Jul. 15, 2015, and German Patent Application No. 102015007032.0, filed on May 29, 2015.

FIELD OF THE INVENTION

The present invention relates to an electric control valve and, more particularly, to an electric control valve for use in a coolant compressor.

BACKGROUND

A known electric control valve for a coolant compressor in a motor vehicle, for example as disclosed in DE 10 2011 117 354 A1, controls the coolant flow from a high-pressure region into a crankcase-chamber-pressure region of the coolant compressor. In a crankcase of a coolant compressor, a plurality of pistons are arranged so as to pump coolant into a high-pressure chamber. The movement of the pistons is guided by a rotating wobble plate.

If the wobble plate, which rotates by a belt drive, has a tilt angle other than zero, this leads to an axial stroke movement of the pistons during a rotation of the wobble plate. Coolant is thus sucked up from the suction chamber of the coolant compressor and pumped into the pressure chamber. The suction chamber is connected to the connector of the coolant compressor that is on the suction pressure side, and this connector is in turn connected, when mounted in the motor vehicle, to the suction-pressure region of the air-conditioning system; in particular to the output of the evaporator. The pressure chamber is connected to the output of the coolant compressor that is on the high pressure side, and this output is in turn connected to the input of the evaporator by way of the high-pressure region of the air-conditioning system, in particular via a heat exchanger (condenser) and an expansion valve. To adjust the delivery volume and control the coolant flow, it is known to vary the tilt angle of the wobble plate in the coolant compressor. If, for example, the coolant compressor is pre-set for a maximum delivery volume, pivoting the wobble plate back brings about a decrease in the axial stroke movement of the pistons of the coolant compressor and thus a reduction in the delivery volume of coolant.

It is further known to undertake this type of control of the coolant flow using a control valve. In this case, the coolant flow between the high-pressure region and the crankcase-chamber-pressure region is controlled by way of the control valve. The control valve has three connectors in the valve housing which are connected respectively to the high-pressure region, the suction-pressure region, and the crankcase-chamber-pressure region of the coolant compressor. The control valve controls the coolant flow between the high-pressure region and the crankcase-chamber-pressure region.

If, for example, in one position the control valve opens the connection between the high-pressure region and the crankcase-chamber-pressure region of the coolant compressor, coolant flows through the control valve from the high-pressure region into the crankcase-chamber-pressure region; this results in a rise in pressure in the crankcase-chamber-pressure region. If in a further position the control valve closes the connection between the high-pressure region and the crankcase-chamber-pressure region of the coolant compressor, coolant flows through the permanently open passage provided in the coolant compressor from the crankcase-chamber-pressure region into the suction-pressure region; this results in a fall in pressure in the crankcase-chamber-pressure region. As a result of the rise in pressure brought about by the control valve in the crankcase-chamber-pressure region, the wobble plate is caused to pivot back. This decreases the axial stroke movement of the pistons of the coolant compressor and the delivery volume of the coolant compressor is reduced. As a result, the pressure in the high-pressure region of the air-conditioning system does not increase any further.

As a result of the fall in pressure brought about by the control valve in the crankcase-chamber-pressure region, the wobble plate is caused to pivot out (in other words to tilt). This increases the axial stroke movement of the pistons of the coolant compressor and the delivery volume of the coolant compressor is increased. As a result, the pressure in the high-pressure region of the air-conditioning system increases further. Usually, the wobble plate is held in a tilted initial position by spring tension, in such a way that, in the event of a subsequent fall in pressure in the crankcase-chamber-pressure region, the wobble plate pivots back into the initial position and ensures an initial setting for the delivery volume in the coolant compressor.

Conventionally, a protection mechanism is integrated into a coolant compressor and prevents the coolant evaporator from icing up, which would reduce or prevent the airflow into the passenger compartment. The coolant evaporator starts to ice up as soon as the suction pressure falls below a particular pressure. An example implementation of a protection mechanism of this type includes a bellows, made of metal, integrated into the control valve, and arranged in the control valve in such a way that it can throttle the coolant compressor down. For this purpose, the bellows is filled with a gas mixture at a particular pressure.

If the pressure prevailing in the suction-pressure region of the control valve falls substantially below the fill pressure of the bellows, the volume of the gas mixture in the bellows increases in relative terms. As a result of the construction, the bellows then unfolds in a concertina shape and accordingly becomes longer. Conversely, if the pressure prevailing in the suction-pressure region of the control valve substantially exceeds the fill pressure of the bellows, the volume of the gas mixture in the bellows decreases in relative terms. As a result of the construction, the bellows then folds up in a concertina shape and accordingly becomes shorter.

This mode of operation of the bellows is exploited by the safety mechanism for the control valve in that the bellows cooperates with the valve body in such a way that, if there is a fall below a critical pressure in the suction-pressure region, it mechanically transfers the valve body into the position in which the coolant compressor is throttled down. During the construction of a control valve, the fill pressure and the type of gas mixture in the bellows are specifically selected in such a way that, if there is a fall below a minimum pressure in the suction-pressure region of the control valve, the bellows moves the valve body into the position in which the high-pressure region is connected to the crankcase-chamber-pressure region.

The rise in pressure in the crankcase-chamber-pressure region, brought about by the bellows, causes the wobble plate to pivot back. As a result, the axial stroke movement of the pistons of the coolant compressor and the delivery volume of the coolant compressor are reduced and the coolant compressor is throttled down. As a result, the pressure in the suction region of the coolant compressor does not fall below the limit value and the coolant evaporator is prevented from icing up.

A bellows of this type, however, is a mechanically operating component which has a slow response time as a result of the construction and also deteriorates with age. Thus, for example, frequent unfolding in a concertina shape and subsequent folding up of the bellows results in material fatigue therein. Further, under some circumstances, it cannot be ensured that the bellows filled with a gas mixture will remain tight throughout its service life.

SUMMARY

An electric control valve according to the invention for a coolant compressor comprises a valve housing, an electric actuating drive, a valve body displaceable by the electric actuating drive between a first position and a second position inside the valve housing, a position sensor determining a position of the valve body, a suction-pressure sensor, and a control system. The control system is adapted to control a coolant flow from a high-pressure region into a crankcase-chamber-pressure region of the coolant compressor by controlling the position of the valve body via the electric actuating drive based on the suction pressure received from the suction-pressure sensor. The control system moves the valve body to the first position to connect the high-pressure region and the crankcase-chamber-pressure region if the suction pressure is below a predetermined threshold.

BRIEF DESCRIPTION OF THE DRAWINGS

The invention will now be described by way of example with reference to the accompanying FIGURES, of which:

FIG. 1 is a sectional view of a control valve according to an embodiment of the invention.

DETAILED DESCRIPTION OF THE EMBODIMENTS

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will be thorough and complete and will fully convey the concept of the disclosure to those skilled in the art.

An electric control valve 100 for a coolant compressor is shown in FIG. 1. The control valve 100 controls a coolant flow from a high-pressure region into a crankcase-chamber-pressure region of the coolant compressor.

The control valve 100, as shown in FIG. 1, includes a valve housing 102. The valve housing 102 has a connector Pd for connection to the high-pressure region of the coolant compressor, a connector Pc for connection to the crankcase-chamber-pressure region of the coolant compressor, and a connector Ps for connection to a suction-pressure region of the coolant compressor.

The control valve 100 further includes a valve body 104 which is displaceable between two different positions inside the valve housing 102. These two positions each form an end position for the valve body 104 inside the valve housing 102. In the first of the two different positions, the valve body 104 inside the valve housing 102 connects the high-pressure region to the crankcase-chamber-pressure region. In the second of the two different positions, the valve body 104 separates the high-pressure region from the crankcase-chamber-pressure region. In an embodiment, the valve body 104 may also have further positions between the end positions inside the valve housing 102. As a result, the valve body 104 takes up not only the two positions in which the high-pressure region and the crankcase-chamber-pressure region are mutually connected or separated, but also further positions in which the high-pressure region and the crankcase-chamber-pressure region are mutually connected but the flow rate is limited.

The valve body 104, as shown in FIG. 1, includes an actuation rod 106 and a shut-off body (or sealing body) 108, which is formed in a plate shape, piston shape, cone shape, or ball shape. A valve body 104 of this type is formed either in a single piece or in a plurality of pieces. A lateral guide, for example in the form of a guide rail or a thread, may be provided in the valve housing 102 cooperating with a corresponding counterpart, for example, in the form of a slide or a thread on the valve body 104 for movement of the valve body 104 between the two end positions. In an embodiment, the slide or thread is disposed on the actuation rod 106 of the valve body 104.

The control valve 100 is controlled by the positioning of the valve body 104 in the two positions in which a passage from the high-pressure region into the crankcase-chamber-pressure region is opened and closed respectively. The passage is determined by the position and shape of the valve body 104 and influences the flow rate of the coolant from the high-pressure region into the crankcase-chamber-pressure region. An electric actuating drive 110 of the control valve 100, shown in FIG. 1, displaces the valve body 104 between the two positions inside the valve housing 102. In various embodiments, the electric actuating drive 110 may include a stepper motor, a DC motor, a servo motor, and a piezoelectric drive. The electric actuating drive 110 displaces the valve body 104 between the two positions by rotation or translation. A rotational movement of the electric actuating drive 110 permits positioning of the valve body 104 with angular precision. In an embodiment, the electric actuating drive 110 displaces the valve body 104 continuously between the two different positions; continuous control of the coolant flow through the control valve 100 from the high-pressure region into the crankcase-chamber-pressure region is thus possible.

The control valve 100, as shown in FIG. 1, further includes a position sensor 112 for determining the position of the valve body 104 displaced by the electric motor 110 inside the valve housing 102. In an embodiment, the position sensor 112 is an electric positon sensor directly detecting the position of the valve body 104. In various embodiments, the position sensor 112 is a Hall effect sensor, a magnetoresistive sensor, an optical sensor, a capacitive sensor and an inductive sensor, each cooperating with a corresponding (reference signal) generator element.

In an alternative embodiment, a control system 116 determines the position of the valve body 104 as a function of a control variable present at the electric actuating drive 110. The position of the valve body 104 is thus determined indirectly by the control system 116. In an embodiment, the control variable or a variable dependent on the control variable, which makes it possible to determine a position of the valve body 104, is the predetermined number of steps (if the electric actuating drive 110 is formed as a stepper motor), the voltage and/or current present (if the electric actuating drive 110 is formed as a DC motor, servo motor or piezoelectric drive), or the power consumption of the electric actuating drive 110.

In another alternative embodiment, the control system 116 determines the position of the valve body 104 as a function of a reference position. In this case, the control system 116 detects whether or not the valve body 104 is in the reference position; for example, the position of the valve body 104 can be referenced using a mechanical stop or an electric switching device. The position of the valve body 104 may be determined independently of valve play and valve wear by using referencing. The control system 116 acts on the electric actuating drive 110 at regular intervals, for example when the coolant compressor is set in operation, to displace the valve body 104 into a defined position (in other words into a reference position), for example into the position where the control valve 100 is closed. This reference position is the new reference point ("zero setting") for further operation.

The control valve 100 includes a suction-pressure sensor 114, which determines a value of the suction pressure in the suction-pressure region. In various embodiment, the suction-pressure sensor 114 is a piezoresistive, a capacitive, an electromagnetic, or an optical pressure sensor. For determining the suction pressure in this manner, the connector Ps is provided in the valve housing 102 for connection to the suction-pressure region of the coolant compressor. The suction-pressure sensor 114 determines the value of the suction pressure by way of the connector Ps in the valve housing 102. In an embodiment, a blind hole is provided in the valve housing 102 as the connector Ps to the suction-pressure region and communicates with the suction-pressure sensor 114.

In an embodiment, the control system 116 for controlling the coolant flow through the control valve 100 is arranged outside the valve housing 102. The controller 116 is spatially separated from the other components of the control valve 100, and in an embodiment, is disposed inside a control device connected to the control valve 100. A safety mechanism provided in the control system 116 rapidly and precisely intervenes in the control of the coolant flow and brings the valve body 104 into a safe position in which the coolant compressor is throttled down, and will be discussed in greater detail below.

The coolant flow is controlled in the control system 116 by way of the value of the suction pressure in the suction-pressure region, which is precisely determined by the suction-pressure sensor 114, with the result that rapid and precise intervention can be ensured if the suction pressure falls below a predetermined threshold. As well as other control variables, the control system 116 initially receives the value of the suction pressure determined by the suction-pressure sensor 114 as an input. Subsequently, the control system 116 checks whether the received value of the suction pressure is below a predetermined threshold (for example a minimum suction pressure).

If the control system 116 determines that the value is below the predetermined threshold, the control system 116 controls the coolant flow in such a way that the valve body 104 connects the high-pressure region to the crankcase-chamber-pressure region. The coolant compressor is thus throttled down by the control valve 100.

The predetermined threshold is stored in the control system 116 in advance and can be adjusted as a function of the coolant or the air-conditioning system. This enables simple, cost-effective adjustment of the safety mechanism to different coolants and/or air-conditioning systems. Because the control system 116 controls the coolant flow as a function of the precisely determined value of the suction pressure, rapid and precise intervention can be ensured if the suction pressure falls below the predetermined suction pressure. If the value falls below the predetermined threshold for the suction pressure, the control system 116 controls the valve body 104 to be displaced into the position in which the high-pressure region and the crankcase-chamber-pressure region are mutually connected. When the value of the suction pressure determined by the suction-pressure sensor 114 falls below the predetermined threshold, the control system 116 intervenes in the control of the coolant flow in such a way that the valve body 104 is displaced into a safe position in which the control valve 100 is open.

A controlling intervention of this type from the control system 116 causes a rise in pressure in the crankcase-chamber-pressure region, and this in turn causes the wobble plate in the coolant compressor to pivot back. This means that the axial stroke movement of the pistons of the coolant compressor is decreased, the delivery volume of the coolant compressor is reduced, and the suction pressure rises.

The control valve 100 includes an electric interface 118, as shown in FIG. 1, via which the value of the suction pressure determined by the suction-pressure sensor 114 can be transmitted externally. Embodiments of the electric interface 118 include a configuration which makes it possible to transmit the value of the suction pressure via a serial peripheral interface (SPI) data bus, via an inter-integrated circuit (I2C) data bus, via a local interconnect network (LIN) data bus, or via a controller area network (CAN) data bus. The electric interface 118 of the control valve 100 connects a power supply at least to the electric actuating drive 110, the suction-pressure sensor 114 and the control system 116. If the position sensor 112 for determining the valve position is electrically powered, it can also be connected to the power supply via the electric interface 118. The control system 116 receives the value of the suction pressure in the suction-pressure region determined by the suction-pressure sensor 114, processes the received value, and makes it possible to transmit the processed value via the electric interface 118.

In an embodiment, the electric actuating drive 110 is disposed inside the valve housing 102 in the high-pressure region. In this case, the high-pressure region is hermetically sealed using a sealing device inside the electric interface 118, which together with the valve housing encloses the high-pressure region. An embodiment of a sealing device of this type is the housing of an electric plug.

In an embodiment, the suction-pressure sensor 114 and the control system 116 are also arranged inside the valve housing 102 in the high-pressure region, as well as the electric actuating drive 110. In an alternative embodiment, only a part of the electric actuating drive 110 is arranged inside the valve housing 102 in the high-pressure region. In this case, the high-pressure region is hermetically sealed using a capsule which is provided in the electric actuating drive 110. In an embodiment, a rotor of the actuating drive 110 is encapsulated to separate it from the stator of the actuating drive 110.

In an alternative embodiment, the high-pressure region inside the valve housing 102 is hermetically sealed off from the outside using a bellows seal. In this case, one side of the bellows seal is fixed to the valve body 104 and the other side is fixed to the valve housing 102. A bellows seal fixed in this manner compresses or extends together with the movement of the valve body 104.

The control valve 100 additionally includes a high-pressure sensor 120, as shown in FIG. 1, which determines a value of the high pressure in the high-pressure region. Thus, in the control valve 100, not only is the suction pressure in the suction-pressure region determined by a suction-pressure sensor 114, but the high pressure in the high-pressure region is also determined in parallel by a corresponding high-pressure sensor 120. For determining the high pressure in this manner, a further stub line between the high-pressure region and the high-pressure sensor is provided in the valve housing 102.

In another embodiment, the control valve 100 further includes a suction-pressure temperature sensor which determines a value of the temperature in the suction-pressure region, and/or a high-pressure temperature sensor which determines a value of the temperature in the high-pressure region. For a measurement of this type of the suction-pressure or high-pressure temperature, the first and/or second temperature sensor have direct access to the coolant in the corresponding suction-pressure and/or high-pressure region. Using the suction temperature (as an alternative to the high-pressure temperature), the fill level of the coolant in the air-conditioning system can be monitored, since in the event of coolant loss the average temperature rises if the conditions are the same in the coolant circuit.

In an embodiment, the high-pressure sensor 120, the suction-pressure temperature sensor and the high-pressure temperature sensor are also arranged inside the valve housing 102 in the high-pressure region. The value of the high pressure in the high-pressure region determined by the second pressure sensor 120 and/or additionally the value of the temperature in the suction-pressure region determined by the suction-pressure temperature sensor and/or additionally the value of the temperature in the high-pressure region determined by the high-pressure temperature sensor can be transmitted externally by the electric interface 118. In an embodiment, the suction-pressure sensor 114 and the suction-pressure temperature sensor and/or the high-pressure sensor 120 and the high-pressure temperature sensor are formed as combined pressure and temperature sensors.

If all four values, specifically the value of the suction pressure, the value of the high pressure, the value of the temperature in the suction-pressure region and the value of the temperature in the high-pressure region, are determined by corresponding sensors, a control device connected to the control valve 100 can calculate the mass flow rate in the coolant circuit. Using the mass flow rate, the torque of the air-conditioning compressor can be calculated. If the current or future torque of the air-conditioning compressor is known, the quantity injected in the motor vehicle can be tuned more precisely, and this leads to fuel savings and thus to reductions in CO2.

What is claimed is:

1. An electric control valve for a coolant compressor, comprising:

a valve housing having a first connector connected to a suction-pressure region of the coolant compressor, a second connector connected to a high-pressure region of the coolant compressor, and a third connector connected to a crankcase-chamber-pressure region of the coolant compressor;

an electric actuating drive;

a valve body displaceable by the electric actuating drive between a first position and a second position inside the valve housing, the valve body connecting the high-pressure region and the crankcase-chamber-pressure region in the first position and separating the high-pressure region and the crankcase-chamber-pressure region in the second position;

a position sensor capable of determining a position of the valve body;

a suction-pressure sensor capable of determining a suction pressure in the suction-pressure region;

a control system adapted to control a coolant flow from the high-pressure region into the crankcase-chamber-pressure region by controlling the position of the valve body via the electric actuating drive based on the suction pressure received from the suction-pressure sensor, the control system moving the valve body to the first position if the suction pressure is below a predetermined threshold; and a suction-pressure temperature sensor capable of determining a suction-pressure temperature in the suction-pressure region.

2. The electric control valve of claim 1, further comprising an electric interface via which the electric actuating drive, the suction-pressure sensor, and the control system are connected to a power supply.

3. The electric control valve of claim 2, wherein the electric interface is capable of externally transmitting the suction pressure determined by the suction-pressure sensor.

4. The electric control valve of claim 1, wherein the position sensor is at least one of a Hall effect sensor, a magnetoresistive sensor, an optical sensor, a capacitive sensor, and an inductive sensor.

5. The electric control valve of claim 1, wherein the position sensor is part of the control system and determines the position of the valve body as a function of one or more control variables present at the electric actuating drive.

6. The electric control valve of claim 1, wherein the position sensor is part of the control system and determines the position of the valve body as a function of a reference position of the valve body.

7. The electric control valve of claim 1, wherein the electric actuating drive is disposed inside the valve housing.

8. The electric control valve of claim 1, further comprising a high-pressure sensor capable of determining a high pressure in the high-pressure region.

9. The electric control valve of claim 8, further comprising a high-pressure temperature sensor capable of determining a high-pressure temperature in the high-pressure region.

10. The electric control valve of claim 9, wherein the suction-pressure sensor and the suction-pressure temperature sensor and/or the high-pressure sensor and the high-pressure temperature sensor are formed as combined pressure and temperature sensors.

11. The electric control valve of claim 9, wherein at least one of the high pressure determined by the high-pressure temperature sensor, the suction-pressure temperature determined by the suction-pressure temperature sensor, and the high-pressure temperature determined by the high-pressure temperature sensor are transmitted externally.

12. The electric control valve of claim 1, wherein the suction-pressure sensor and the control system are disposed inside the valve housing.

13. An electric control valve for a coolant compressor, comprising:

a valve housing having a first connector connected to a suction-pressure region of the coolant compressor, a second connector connected to a high-pressure region of the coolant compressor, and a third connector connected to a crankcase-chamber-pressure region of the coolant compressor;

an electric actuating drive;

a valve body displaceable by the electric actuating drive between a first position and a second position inside the valve housing, the valve body connecting the high-pressure region and the crankcase-chamber-pressure region in the first position and separating the high-pressure region and the crankcase-chamber-pressure region in the second position;

a position sensor capable of determining a position of the valve body;

a suction-pressure sensor capable of determining a suction pressure in the suction-pressure region; and a control system adapted to control a coolant flow from the high-pressure region into the crankcase-chamber-pressure region by controlling the position of the valve body via the electric actuating drive based on the suction pressure received from the suction-pressure sensor, the control system moving the valve body to the first position if the suction pressure is below a predetermined threshold, the position sensor is part of the control system and determines the position of the valve body as a function of one or more control variables present at the electric actuating drive.

14. An electric control valve for a coolant compressor, comprising:

a valve housing having a first connector connected to a suction-pressure region of the coolant compressor, a second connector connected to a high-pressure region of the coolant compressor, and a third connector connected to a crankcase-chamber-pressure region of the coolant compressor;

an electric actuating drive;

a valve body displaceable by the electric actuating drive between a first position and a second position inside the valve housing, the valve body connecting the high-pressure region and the crankcase-chamber-pressure region in the first position and separating the high-pressure region and the crankcase-chamber-pressure region in the second position;

a position sensor capable of determining a position of the valve body;

a suction-pressure sensor capable of determining a suction pressure in the suction-pressure region;

a control system adapted to control a coolant flow from the high-pressure region into the crankcase-chamber-pressure region by controlling the position of the valve body via the electric actuating drive based on the suction pressure received from the suction-pressure sensor, the control system moving the valve body to the first position if the suction pressure is below a predetermined threshold;

an electric interface via which the electric actuating drive, the suction-pressure sensor, and the control system are connected to a power supply;

a high-pressure sensor capable of determining a high pressure in the high-pressure region; and a suction-pressure temperature sensor capable of determining a suction-pressure temperature in the suction-pressure region.

15. The electric control valve of claim 14, further comprising a high-pressure temperature sensor capable of determining a high-pressure temperature in the high-pressure region.

16. The electric control valve of claim 15, wherein the suction-pressure sensor and the suction-pressure temperature sensor and/or the high-pressure sensor and the high-pressure temperature sensor are formed as combined pressure and temperature sensors.

17. The electric control valve of claim 15, wherein at least one of the high pressure determined by the high-pressure temperature sensor, the suction-pressure temperature determined by the suction-pressure temperature sensor, and the high-pressure temperature determined by the high-pressure temperature sensor are transmitted externally by the electric interface.

* * * * *